US007293566B2

(12) United States Patent
Thall

(10) Patent No.: US 7,293,566 B2
(45) Date of Patent: Nov. 13, 2007

(54) HAIR ACCESSORY FOR FORMING AND HOLDING HAIR BUN

(76) Inventor: Barbara Ward Thall, 7 Undercliff Dr., Montclair, NJ (US) 07042

( * ) Notice: Subject to any disclaimer, the term of this patent is extended or adjusted under 35 U.S.C. 154(b) by 109 days.

(21) Appl. No.: 10/992,458

(22) Filed: Nov. 18, 2004

(65) Prior Publication Data

US 2006/0032515 A1 Feb. 16, 2006

Related U.S. Application Data

(60) Provisional application No. 60/600,485, filed on Aug. 11, 2004.

(51) Int. Cl.
*A45D 8/40* (2006.01)

(52) U.S. Cl. ..... 132/274

(58) Field of Classification Search ..... 132/274, 132/55; D28/32, 93, 41, 39; 2/174, DIG. 11
See application file for complete search history.

(56) References Cited

U.S. PATENT DOCUMENTS

| | | | | |
|---|---|---|---|---|
| D28,239 | S | 2/1898 | Millhiser | |
| 2,122,171 | A | 6/1938 | Alexander | |
| D141,169 | S | 2/1945 | Petitta | |
| 2,765,798 | A | 10/1956 | Carvell | |
| 2,775,245 | A | 12/1956 | Behr | |
| 2,869,135 | A | 1/1959 | Wagenfeld | |
| 2,884,645 | A | 5/1959 | Berg | |
| 3,693,637 | A | 9/1972 | Sidelman | |
| 3,746,016 | A | 7/1973 | Goodman | |
| 5,411,040 | A | 5/1995 | Forrest | |
| 5,465,741 | A | 11/1995 | Dvorak | |
| 5,472,003 | A | 12/1995 | Frame et al. | |
| 5,590,670 | A | 1/1997 | Allred | |
| 5,595,199 | A | 1/1997 | Solomon et al. | |
| 5,621,919 | A | 4/1997 | Graham | |
| D385,658 | S | 10/1997 | Brandenburg | |
| 5,732,720 | A | 3/1998 | Sears | |
| 5,878,756 | A | 3/1999 | Bilodeau | |
| 5,920,909 | A | 7/1999 | Ellsworth et al. | |
| 5,926,848 | A | 7/1999 | Bartholomae | |
| 5,970,991 | A | 10/1999 | Srivastava | |
| 5,988,183 | A | 11/1999 | Huang | |
| 6,047,708 | A | 4/2000 | Panel et al. | |
| 6,182,672 | B1 | 2/2001 | Abasta-Douglas et al. | |
| D448,927 | S | 10/2001 | Vazquez | |
| 6,435,194 | B1 | 8/2002 | Babay | |
| 6,516,853 | B1 * | 2/2003 | Gabrielson et al. | 156/443 |
| 2002/0056467 | A1 * | 5/2002 | Srivastava | 132/273 |
| 2005/0109361 | A1 * | 5/2005 | Klug | 132/275 |

* cited by examiner

*Primary Examiner*—Todd E. Manahan
*Assistant Examiner*—Rachel A. Running
(74) *Attorney, Agent, or Firm*—Gerald E. Hespos; Anthony J. Casella

(57) ABSTRACT

A hair accessory includes a pouch formed from an elastic material and having an opening edge. An elastic loop is secured to the pouch at a hem formed at the open edge of the pouch. An elastic band is interengaged with the elastic loop. The elastic band is used to secure hair in a ponytail. The hair then is formed into a bun and the pouch is snapped into engagement over the bun to hold the hair in the bun shape.

13 Claims, 9 Drawing Sheets

HAIR ACCESSORY FOR FORMING AND HOLDING HAIR BUN

This application claims priority on U.S. Provisional Patent Appl. No. 60/600,485, filed Aug. 11, 2004.

BACKGROUND OF THE INVENTION

1. Field of the Invention

The invention relates to a small inexpensive flexible device that can be used to hold hair in a tightly formed bun.

2. Description of the Related Art

Long hair provides women with many styling options and can be very attractive. However, long hair can be a tremendous inconvenience to a woman who is involved in athletics or many recreational activities that involve vigorous movement. More particularly, long hanging hair retains heat and leads to discomfort and excessive perspiration. Furthermore, many athletic and recreational activities tend to tangle hair and complicate efforts to clean and style the hair at the end of the athletic or recreational activity.

Many women employ a simple inexpensive commercially available elastic band to hold their hair in a ponytail while they are engaged in an athletic or recreational activity. The elastic band typically is covered by a smooth synthetic fabric to prevent the elastic band from damaging the hair and to facilitate both placement and removal of the elastic band. The typical elastic band is used by first gripping the hair in a tight ponytail with one hand and then passing the elastic band over the ponytail. The elastic band typically defines an unbiased diameter that exceeds the diameter of the ponytail. Hence, the elastic band typically is stretched, rotated 180° and passed again over the ponytail. This process typically is repeated two or three times to ensure a tight fit of the doubled and redoubled elastic band over the ponytail. The elastic bands of this type generally work quite well for holding the hair in a ponytail. However, the woman still must contend with the long ponytail while engaged in a strenuous athletic or recreational activity. Furthermore, long sections of the hair distally of the elastic band are prone to entanglement due to the bouncing and swaying of the ponytail during the vigorous activity or during swimming. Additionally, the elastic bands are not very attractive.

Some elastic bands are enveloped in a loosely bunched tube of decorative fabric. These products often are referred to as "scrunchies" and are much more attractive than a simple elastic band. Scrunchies, however, suffer from the same problems as generic elastic bands while a woman is engaged in a vigorous activity.

Barrettes are available in many attractive styles and are useful for holding hair in an orderly manner similar to a ponytail. However, barrettes are not well suited to vigorous activities.

Headbands also are commercially available and can be very attractive. However, headbands are even less suitable than barrettes for vigorous activity.

Ballet dancers, figure skaters and gymnasts often prefer to keep their hair in a tightly formed bun. The bun is very well suited for even the most vigorous activity. However, ballet dancers and figure skaters must secure their buns with several hairpins. Proper placement of hairpins is time consuming and cumbersome, particularly in view of the fact that the woman cannot see the precise locations while she is manipulating the pins. Improperly positioned pins may not hold the hair sufficiently tight through the course of a vigorous athletic or recreational workout.

Food service personnel often are required to wear hair nets, hats or other items that will hold their hair in place. Many hats and hair nets are uncomfortable and unattractive. Many food service workers have direct contact with consumers or work in areas that are visible to consumers. Thus, companies that offer food services would be receptive to products that would meet required hygienic conditions for hair retention in an aesthetically attractive manner. Additionally, a hair retention device that coordinated with a uniform worn by a food service worker would be well received.

Mechanical devices have been developed to hold hair in a bun shape. Such devices are shown, for example in U.S. Pat. No. 2,775,245 and U.S. Pat. No. 3,746,016. These devices may be acceptable for normal activities but generally are not adequate for retaining the hair in a tight bun while the woman is engaged in a vigorous athletic or recreational activity.

Manufacturers of athletic items are constantly looking for ways to display their trademarks. Trademarks are prominently displayed on hats and helmets used in athletic activities. Many athletic activities, however, are not well suited to conventional headwear such as hats or helmets. For example, runners, recreational swimmers, soccer players, golfers, basketball players, tennis players, surfers, wind surfers, and rowers, to name a few, generally do not wear hats or helmets. Headwear for these activities would be well received by manufacturers of other supporting attire as a vehicle for promoting their trademarks.

Young girls often have a collection of decorative hair accessories including barrettes, clips and the like. The hair accessories for young girls may be selected to coordinate with clothing worn on a particular day. In other situations, young girls wear hair accessories that play upon a seasonal theme (e.g., pumpkins for Halloween, bells for Christmas, bunnies for Easter).

In view of the above, it is an object of the subject invention to provide a simple, inexpensive and easy to use device for holding hair in a tight bun.

SUMMARY OF THE INVENTION

The invention relates to a device for tightly holding hair in a bun. The device includes a small fabric pouch dimensioned to envelope hair that has been folded into a bun. The pouch includes an opening edge that can be placed over the hair. At least portions of the pouch adjacent the opening preferably are elastic and hence can exert a biasing force around portions of the bun substantially adjacent the scalp. The elasticity of this opening edge of the pouch preferably is sufficient to hold the pouch on the bun. However, the elasticity of the opening edge to the pouch need not be sufficiently strong to hold the hair in a ponytail or bun shape. The entire pouch may be formed from an elastic material such as a material that comprises spandex. Portions of the pouch adjacent the opening edge may be folded inwardly to define a hem. An elastic loop then may be secured adjacent the opening edge of the pouch and maybe secured within the hem.

The pouch may be formed from a single unitary piece of spandex. In this embodiment, the loop of elastic around the opening edge of the pouch imparts the pouch shape to the unitary piece of material. Preferably, however, the pouch is formed from two registered sheets of material that are sewn or otherwise secured to one another around all of their registered edges except for the edges that will define the opening. For example, each sheet may approximately define one half of an elliptical or oval sheet. The semi-elliptical sheets may be placed in registration with one another and may be secured around the curved edges. The linear edges will define the opening to the pouch.

In other embodiments, the pouch may be formed from more than two sheets of material. For example, the pouch may be formed from four sheets of material each of which is approximately one-quarter part of a sector of a spherical or elliptoid surface. More particularly, each of the four sheets has two convexly curved edges and one substantially straight edge connecting the curved edges. The curved edges are sequentially connected to one another. The linear edges then will define the opening to the pouch. This latter embodiment may be appropriate where the respective sheets of material are disposed to alternate around the pouch. Thus, the pouch may generally resemble a pinwheel shape with alternating colors. A pouch of this type may be desirable when the device is to be used by team members and the alternating colors of the pouch may be selected in accordance with the team colors.

In still other embodiments, the curved edges of two generally semi-elliptical or semi circular pieces of material may be secured to opposite parallel edges of an elongate generally rectangular strip. With this optional design the finished pouch can have three stripes with colors selected to coordinate with the colors of the clothing that is being worn or to substantially match team colors.

The fabric of the pouch may have a decorative outer face and a less decorative inner face. The two sheets of the fabric that form the pouch preferably are positioned so that their decorative faces are inward and facing one another. The edges then are sewn or otherwise secured together about the entire periphery except for the edges that will define the opening. The resulting seam need not be attractive. The elastic loop may then be placed over the pouch adjacent the opened and unattached edges. The open edges then may be folded and hemmed over the elastic loop so that the elastic loop is secured within the hem. This attachment of the fabric to itself at the hem may be by conventional stitching, adhesive, heat welding or the like. The pouch may then be inverted so that the decorative surfaces of the material face outwardly and so that the unsightly seams are inside.

The pouch may further include non-fabric adornments secured thereto. For example, a hair accessory for a young girl could be made to resemble a ladybug, and the pouch may have black buttons to resemble the spots on a ladybug. The pouch also can be made to resemble a face, and button or other non-fabric adornments can be attached to the pouch to resemble features of a face. Seasonal adornments can include bells at Christmas. Adornments intended for adults can include silk flowers, feathers and other decorative items.

The device of the subject invention further includes an elastic band formed into a loop and interengaged with pouch at the opening to the pouch. The elastic band is looped through the elastic loop that extends around the opening to the pouch, or is interengaged with the pouch itself. Thus, the elastic band and the elastic loop are interengaged with one another in much the same way that two links of a chain are connected.

The device of the subject invention is employed by initially holding the hair with one hand. The elastic band of the device then is expanded and placed over the ponytail so that the pouch is adjacent to the hair and above the ponytail. The person then twists and wraps the ponytail into a bun while keeping the pouch on top of the bun. The pouch then is flipped down over the bun and the elastic hem of the pouch is expanded and snapped into secure engagement around the bun. The initial engagement of the elastic band around the ponytail is secured sufficiently to hold the hair tightly. The pouch, and particularly the elastic fabric of the pouch and the elastic loop around the opening to the pouch holds the bun in a tightly contained state and holds the pouch on the bun. The woman then can engage in the most vigorous athletic or recreational activity without the pouch separation from the hair and without the bun loosening.

The pouch can be formed from any decorative fabric and can be color coordinated with other clothing that may be worn by the woman. Hence, the pouch can be formed from a material that matches the colors of an athletic uniform. The pouch also can be imprinted with a team logo or with a trademark for a manufacturer of athletic equipment or a food services company. The device can be removed easily from the hair and will not become entangled with the hair.

The device of the invention is particularly useful for women engaged in an athletic activity. However, the device can be used any time merely in view of its decorative appearance and its convenience. For example, beachgoers may simply want to wrap and secure their hair to avoid the stresses and damage caused by the combination of water, sand and sun. In this regard, a woman may also apply conditioner to wet hair and then secure the wet hair in the device. The device can be removed at a convenient time and the conditioner can be rinsed from the hair. The hair then can be dried properly. The conditioner in the hair helps to maintain healthy hair and prevents tangles when the hair is removed from the device. The device also can be used simply to temporarily secure wet hair at a time when proper drying of the hair is inconvenient.

DETAILED DESCRIPTION OF THE PREFERRED EMBODIMENTS

Figure 1:
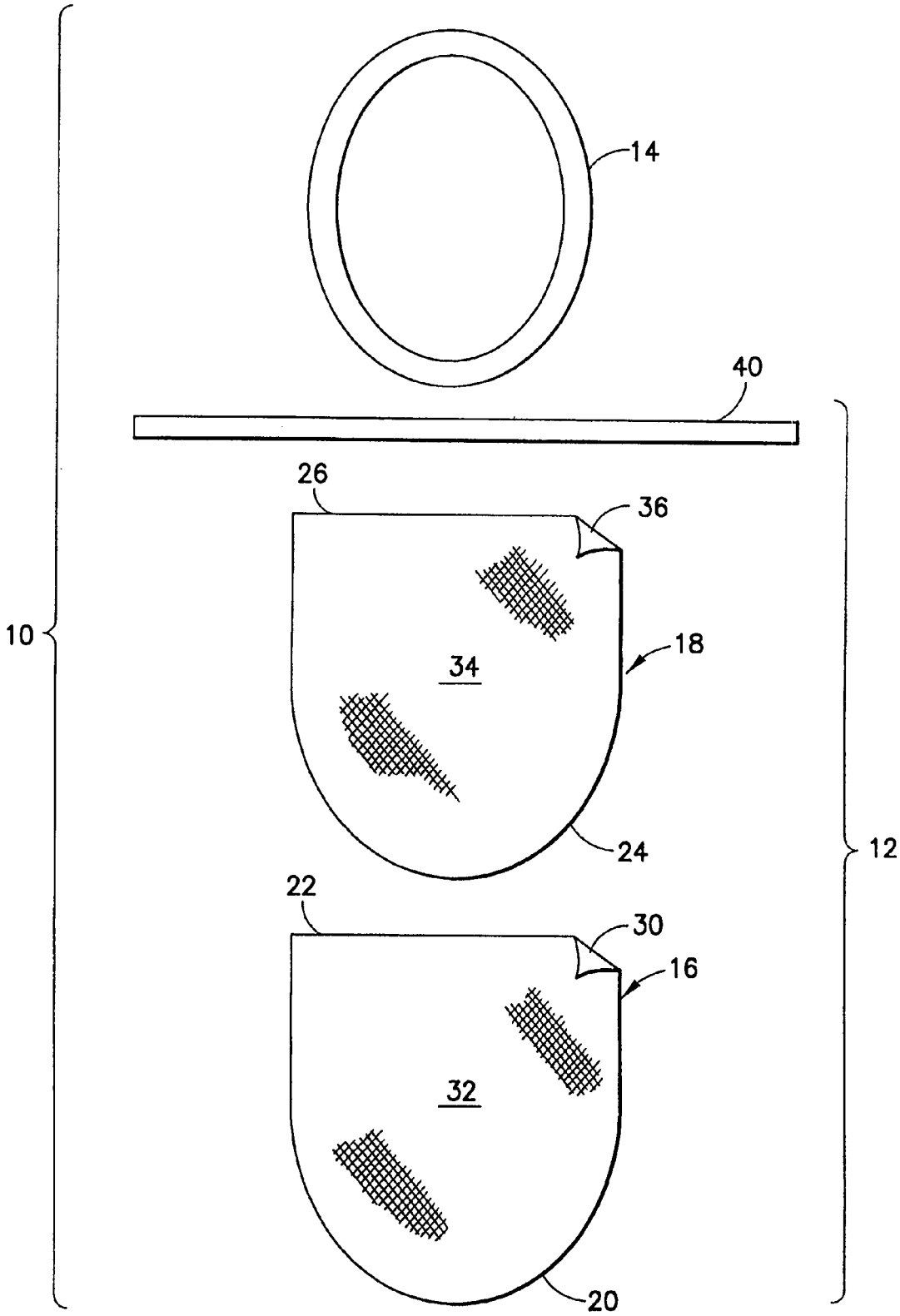
FIG. 1 is an exploded perspective view of a hair accessory in accordance with the invention.

An accessory for forming and holding hair in a bun is identified generally by the numeral 10 in FIGS. 1-13. The accessory 10 includes a pouch 12 and an elastic band 14 that are interengaged with one another. The pouch 12 is formed from a resilient woven material, that includes elastic fibers, such as spandex or LYCRA®. The remaining content of the fabric is selected in accordance with the intended use of the accessory and the desired appearance. For example, the remaining content of the fabric can be nylon, polyester, cotton or any other fabric. The fabric may be formed to provide two-way or four-way stretch. Fabrics that have proved to be acceptable include moleskin (85% nylon, 15% spandex, heavy weight); miliskin (85% nylon, 15% spandex, medium weight); stretch velvet (90% nylon, 10% spandex, medium weight); neoprene (80% polyester, 20% spandex, medium-to-heavy weight); stretch terry cloth (80%-90% cotton, 20%-10% LYCRA®, stretch fleece (such as POLARTEC® POWERSTRETCH®, which is 88% polyester and 12% spandex); and fishnet (90% nylon, 10% spandex, light weight). Two layers of fabric may be employed and are preferred for pouches 12 formed from stretch lace or fishnet. For example, stretch lace or fishnet may be lined with the above-described miliskin.

The pouch 12 of the preferred embodiment is formed from first and second similarly dimensioned sheets of material 16 and 18. Each sheet of material 16, 18 is cut into a substantially semi-elliptical shape. The sheet 16 has curved edge 20 and a substantially straight edge 22. The sheet 18 also has a curved edge 24 and a substantially straight edge 26. FIG. 1 shows the curved edges 20 and 24 intersecting the straight edges 22 and 26 at substantially right angles. However, the curved edges 20 and 24 may converge along an arc towards one another to intersect the straight edges 22 and 26 at angles greater than the illustrated right angles. The sheet 16 has an outer surface 30 and an inner surface 32. Similarly the sheet 18 has an outer surface 34 and an inner surface 36. The outer surfaces 30 and 34 preferably are more decorative or more finished than the inner surfaces 32 and 36.

The elastic band 14 preferably is an "ouchless" braided elastic band that is formed without a metallic band connecting the elastic into a closed loop. Rather, the loop of elastic is continuous and has no metallic band. The elastic of the band preferably has a width of about 4 mm, but smaller braided elastic bands can be used, especially if the device is intended for children. Suitable braided elastic bands are provided by Goody Products, Inc. and Scunci International. Elastic bands of this type often are referred to generically as ponytail elastics.

Figure 2:
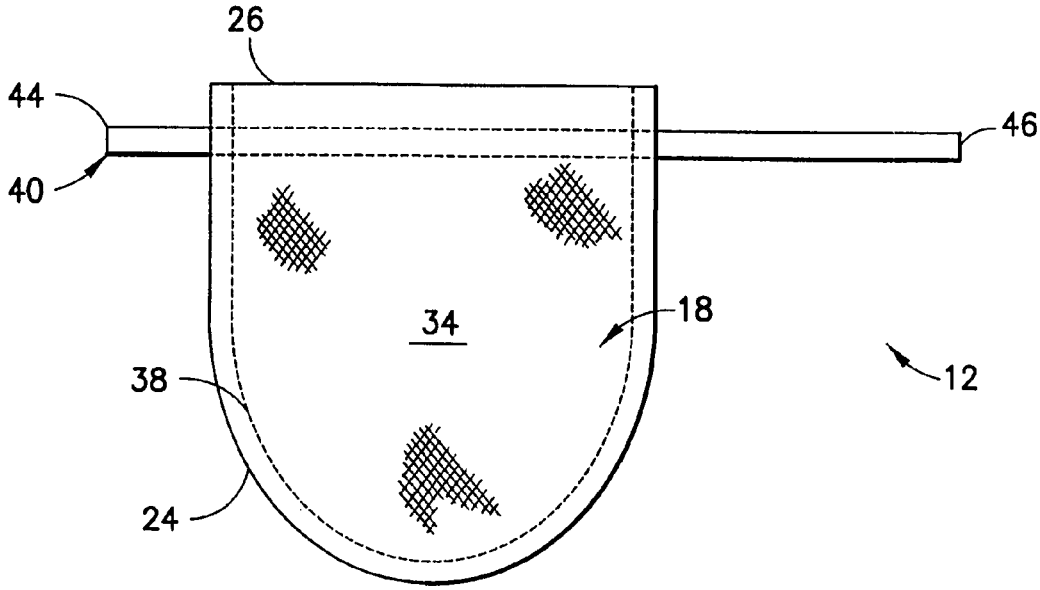
FIG. 2 is a top plan view of the pouch of the accessory in a partly assembled condition.

The sheets 16 and 18 are positioned so that the decorative outer surfaces 30 and 34 are in face-to-face engagement with one another and so that the curved edges 20 and 24 substantially register. The sheets 16 and 18 then are secured to one another substantially around their curved edges 20 and 24 to form a seam 38, as shown in FIG. 2. The attachment of the curved edges 20 and 24 may be achieved by conventional sewing. However, adhesive or heat welding may be employed with certain fabrics.

Figure 3:
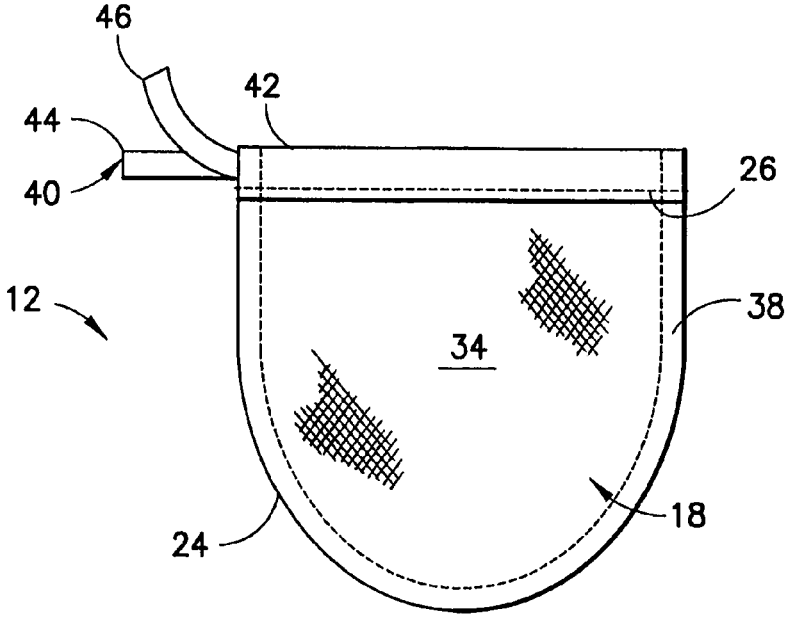
FIG. 3 is a top plan view of the pouch assembled beyond the condition shown in FIG. 2.

The pouch 12 further includes an elastic strip 40 that is positioned around the pouch 12 in proximity to the substantially straight edges 22 and 26 as shown in FIG. 2. The elastic strip 40 preferably is a braided elastic cord and defines a width of ¼-½". Although the illustrated elastic strip 40 has a width substantially greater than its thickness, a round braided elastic strip also can be employed. The 22 and 26 edges then are folded over the elastic strip 40 and are secured to the remainder of the pouch 12 by sewing, adhesive or heat welding to form a hem 42 as shown in FIG. 3.

Figure 4:
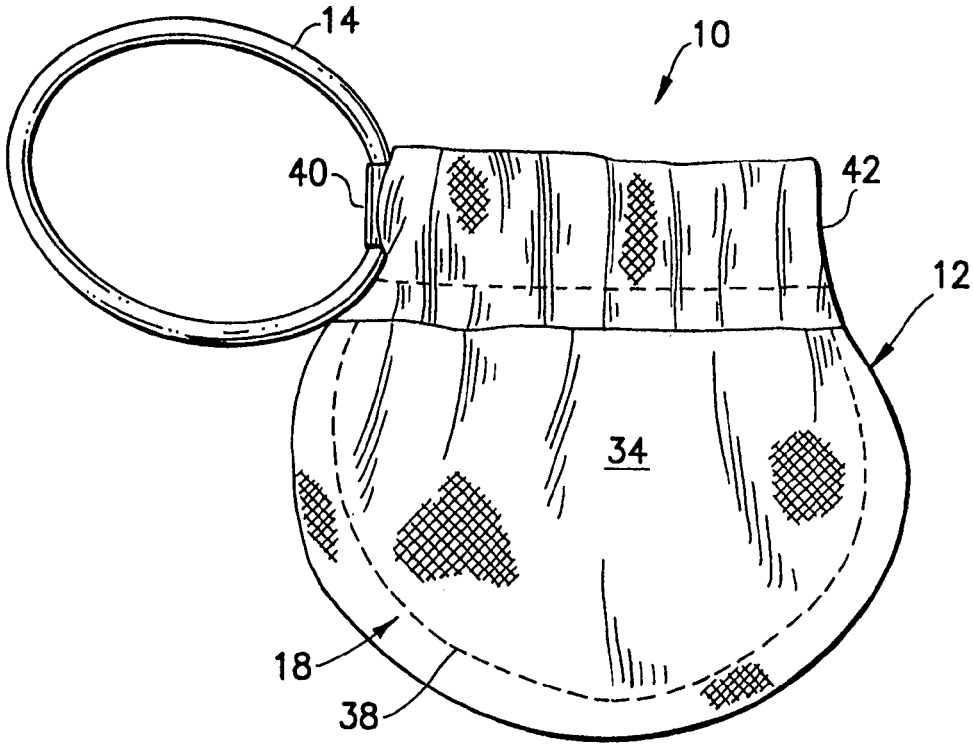
FIG. 4 is a top plan view of the elastic band assembled with the elastic loop of the pouch as shown in FIG. 3.
Figure 5:
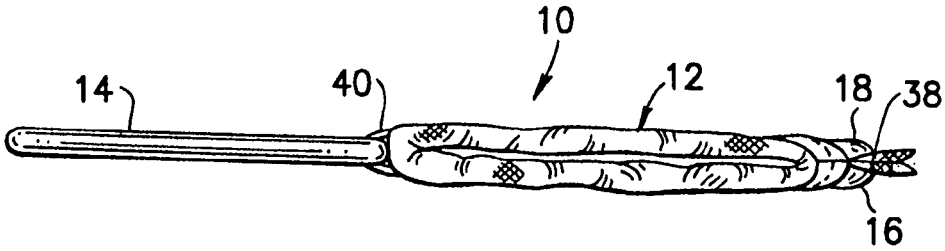
FIG. 5 is an end elevational view of the accessory of FIG. 4 depicting the open end of the pouch.
Figure 6:
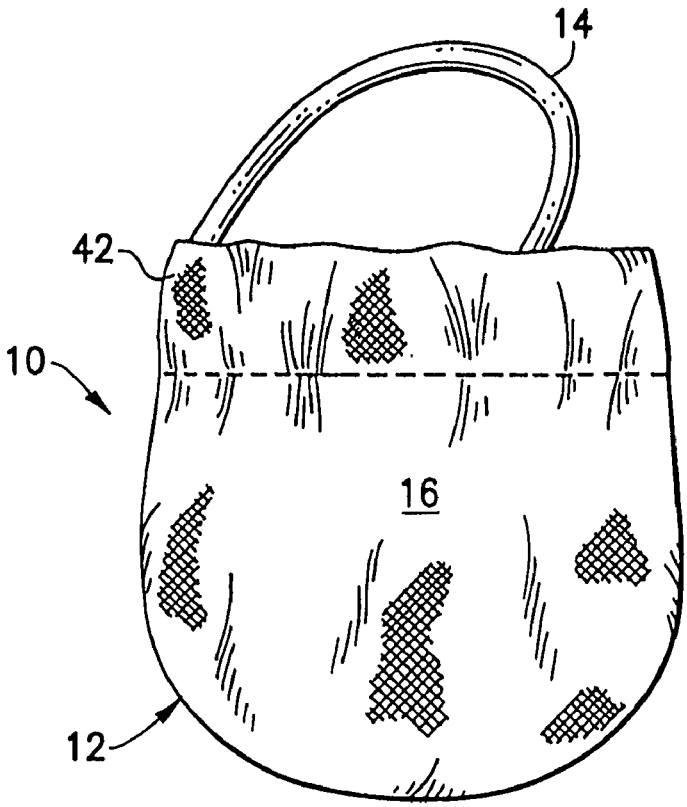
FIG. 6 is a top plan view of the pouch inverted from the FIG. 5 condition and showing the pouch with the decorative surfaces of the fabric facing outwardly.
Figure 7:
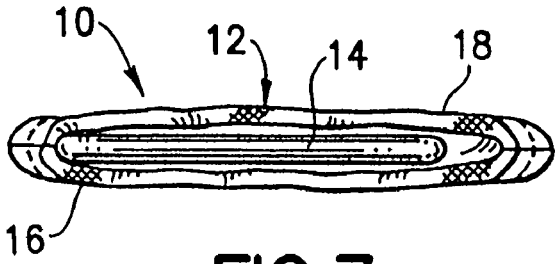
FIG. 7 is an end elevational view of the accessory showing the open end of the pouch.
Figure 8:
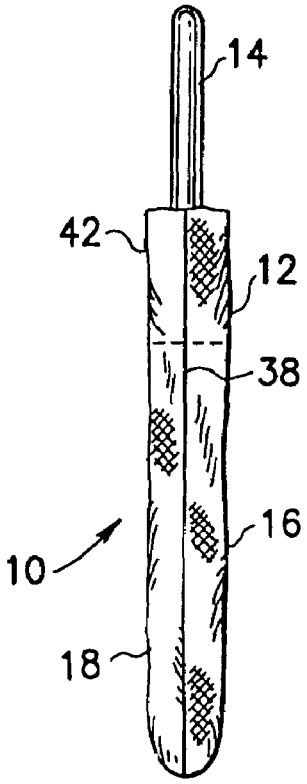
FIG. 8 is a first side elevational view of the accessory.
Figure 9:
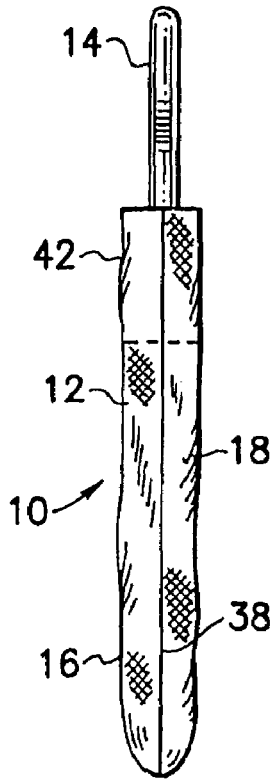
FIG. 9 is a second side elevational view of the accessory.
Figure 10:
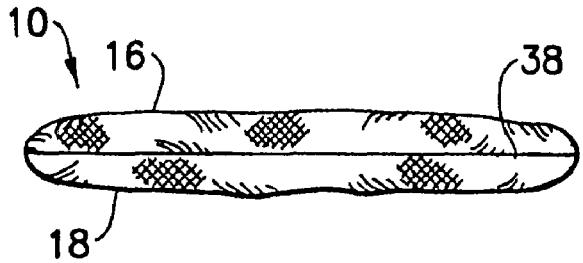
FIG. 10 is an end elevational view of the accessory in the closed end of the pouch.

The free ends 44 and 46 of the elastic strip 40 then are looped through the elastic band 14 and are secured together to define a continuous elastic loop that is interengaged with the elastic band 14 in much the same manner as two links of a chain, as shown if FIG. 4. The pouch 12 then can be inverted, as shown in FIGS. 6-10, so that the decorative outer faces 30 and 34 of the sheets 16 and 18 face outwardly and so that the seam 38 is hidden within the pouch 12.

Figure 11:
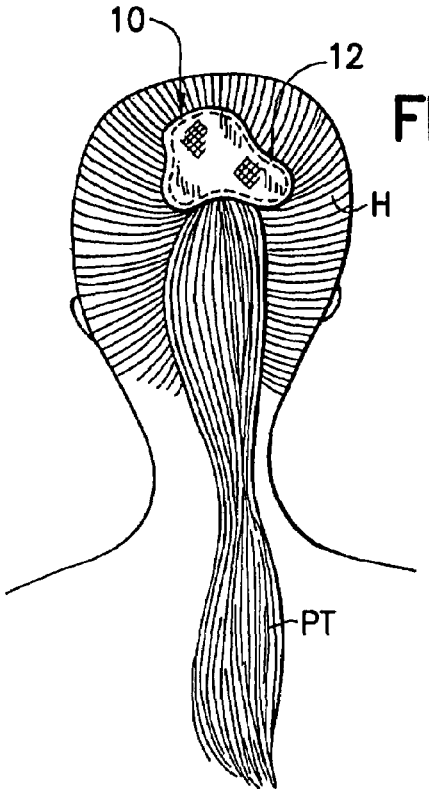
FIG. 11 is schematic view showing a first stage of mounting the accessory.
Figure 12:
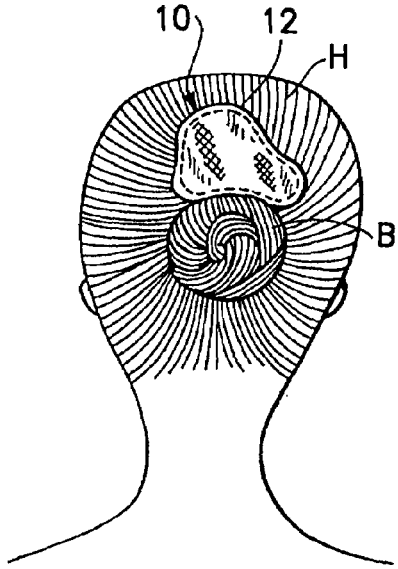
FIG. 12 is schematic view showing a separate stage of mounting the accessory.
Figure 13:
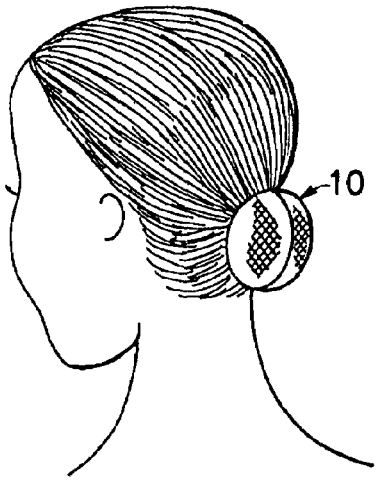
FIG. 13 is a perspective view showing the accessory in its fully mounted condition.

The accessory 10 is employed by initially griping the hair H with one hand in a fairly tight ponytail PT, as shown in FIG. 11, and passing the ponytail PT through the elastic band 14. The elastic band 14 may be expanded, twisted 180° and mounted a second or third time over the ponytail PT so that the ponytail PT is held tightly by the elastic band 14. This formation of the ponytail PT, preferably is carried out while the pouch 12 is disposed above the elastic band 14 and substantially adjacent the pull-back sections of the hair H proximally of the ponytail PT. Portions of the hair H distally of the elastic band 14 then are folded neatly into a fairly compressed bun B in any convenient manner, as shown in FIG. 12. The pouch 12 then is expanded to envelop the bun B, as shown in FIG. 13. The elastic loop formed by the strip 40 and enveloped in the hem of the pouch 12 effectively snaps into engagement over the bun B to engage the cross-sectionally smaller portion of the hair H held by the elastic band 14. Thus, the pouch 12 is held securely in position on the bun B and holds the bun B in a tight neatly contained shape. The user then can engage in any physical activity, including swimming or other water-based activities, while maintaining the hair H in a neat convenient bun B and without entangling the hair H.

Figure 14:
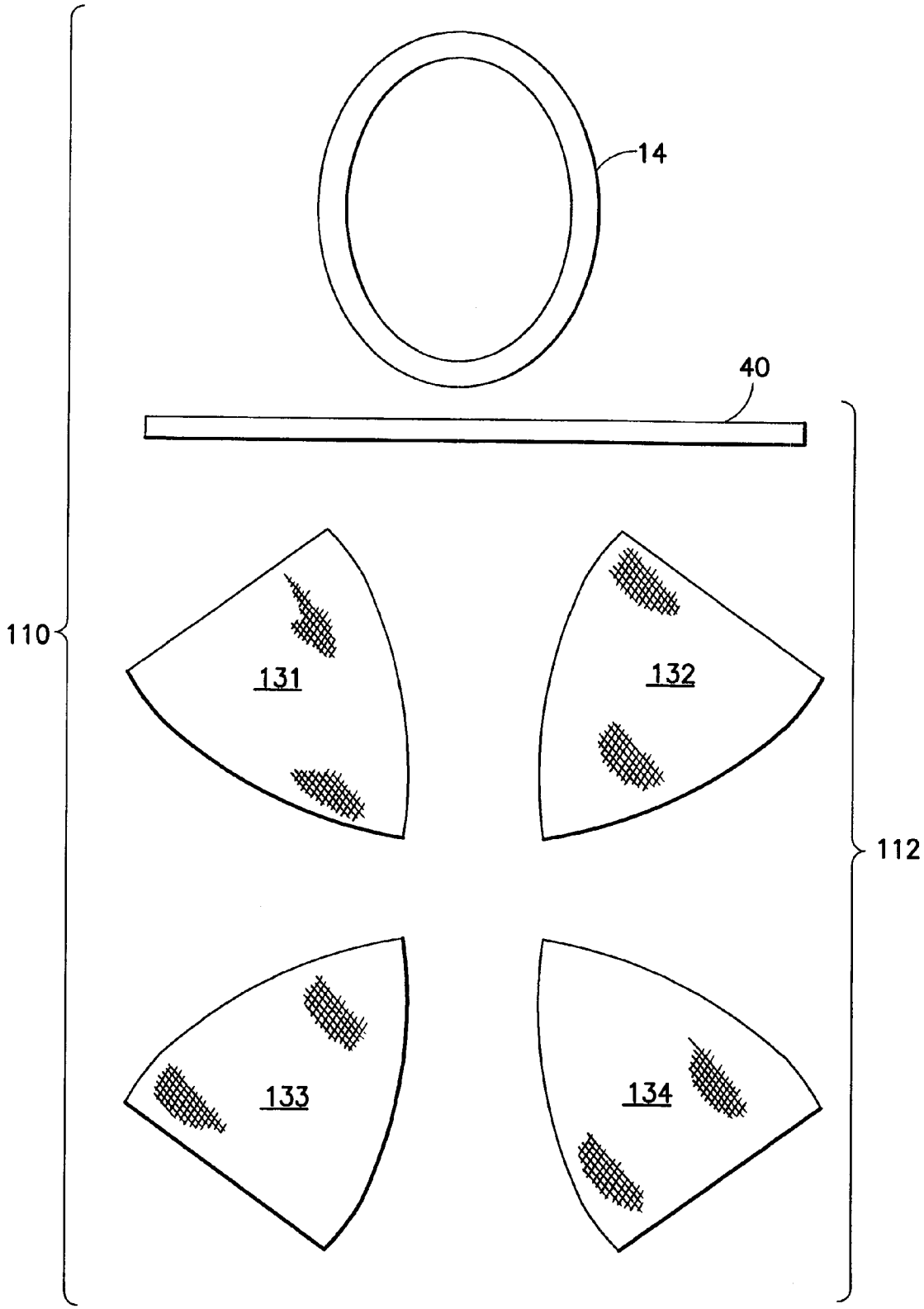
FIG. 14 is a top plan view of fabric for forming a second embodiment of the accessory.
Figure 15:
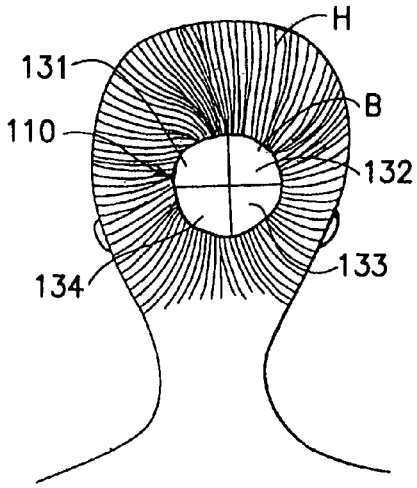
FIG. 15 is a schematic view showing the second embodiment of the accessory as worn.

FIGS. 14 and 15 show an alternate accessory 110 with a pouch 112 formed from four sheets of material 131, 132, 133 and 134. Each sheet approximately defines ¼ of an elliptical or oval shape. The sheets 131 and 133 may be formed from substantially identical materials, whereas the sheets 132 and 134 are formed from identical materials that are different from the materials in the sheets 131 and 133. The sheets are secured together to form a generally pinwheel pattern of alternating materials as shown most clearly in FIG. 15. The colors may be selected to coordinate with other clothing being worn, such as colors presented in a team uniform.

Figure 17:
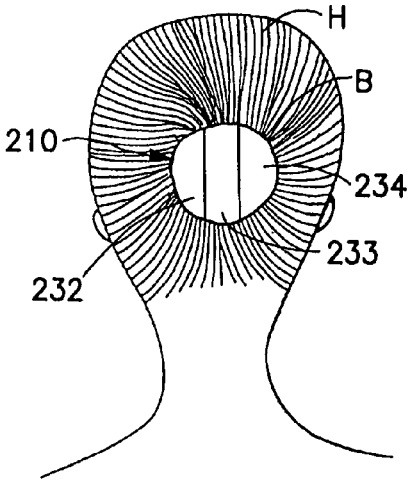
FIG. 17 is a schematic view showing the third embodiment of the accessory as worn.
Figure 16:
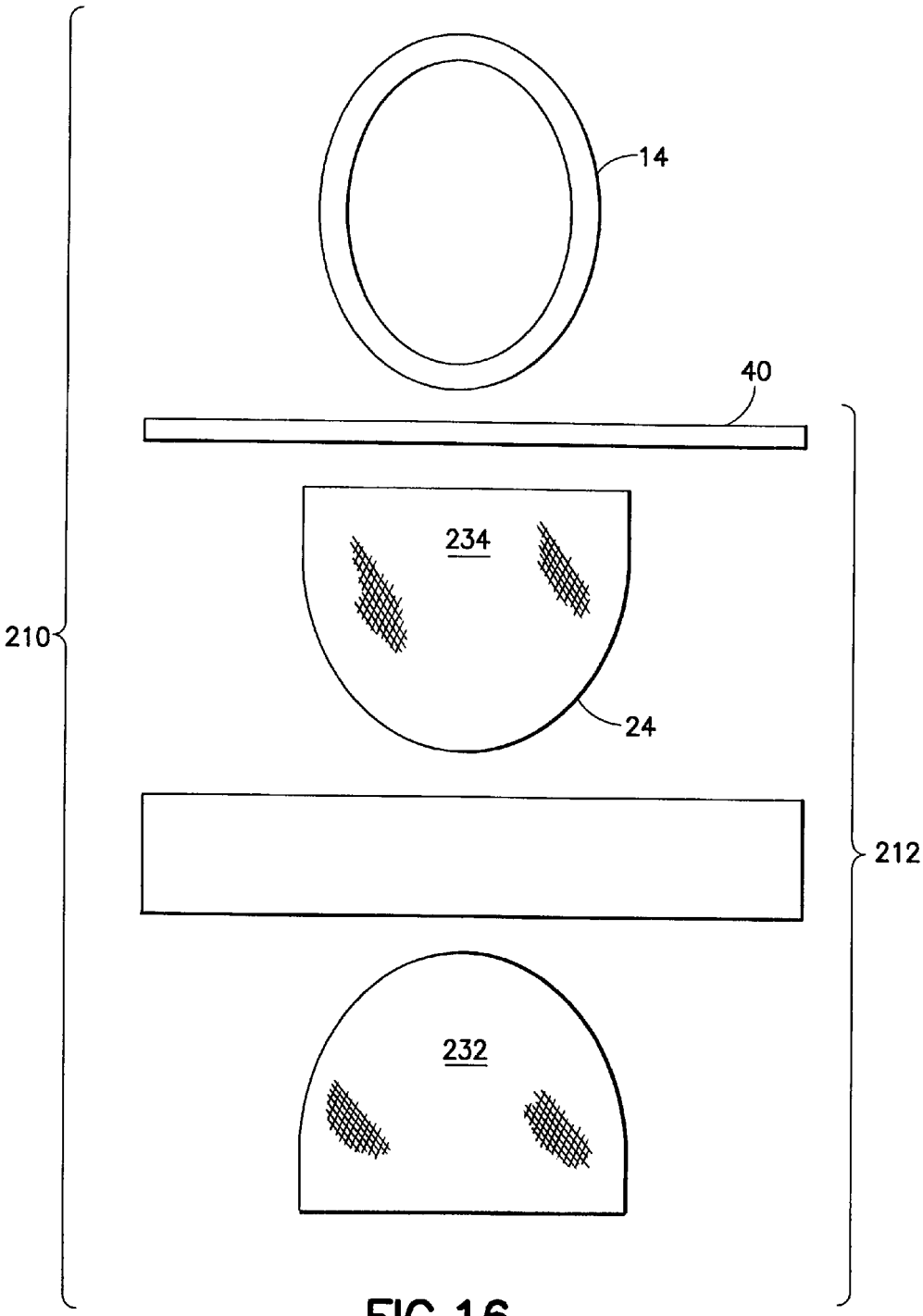
FIG. 16 is a top plan view of fabric for forming a third embodiment of the accessory.

FIGS. 16 and 17 show an accessory 210 with a pouch 212 formed from first and second generally semi-circular sheets 232 and 234 and an elongate rectangular sheet 233. The curved edges of the semi-circular sheets 232 and 234 are secured to the long side edges of the rectangular sheet 233. The rectangular sheet 233 preferably is formed from a different material than the sheets 232 and 234. Thus, as shown in FIG. 17, the accessory has an elongate stripe of a different color, design and/or texture than side portions of the accessory 210. As in the preceding embodiment, the different fabric can be selected to color coordinate with clothing being worn, such as a team uniform.

Figure 18:
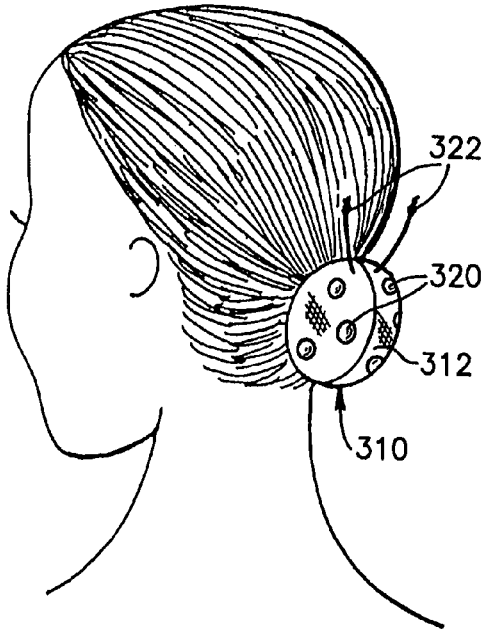
FIG. 18 is a perspective view of a fourth embodiment of the accessory as worn.

FIG. 18 shows an accessory 310 that may be formed similar to any of the above-described accessories 10, 110 and 210. However, the accessory 310 further includes non-fabric adornments. In particular, the accessory 310 includes a fabric pouch 312 with buttons 320 secured thereto in a manner that will resemble the spots on a ladybug. The accessory then further includes plastic filaments 322 that project from the pouch 312 in a manner suggestive of an antenna on an insect. The accessory 310 is presented as merely one of many optional designs that include non-fabric adornments.

While the invention has been described with respect to certain preferred embodiments, it is apparent that various changes can be made without departing from the scope of the invention as defined by the appended claims. For example, the illustrations depict a single device for holding hair in a single bun symmetrically on the rear of the wearer's head. However, slightly smaller devices can be used in pairs to hold pigtails in a bun-shape at substantially left and right positions on the rear of the wearer's head. Additionally, the embodiments of FIGS. 14 and 15 describe the four sheets as being formed from two alternating colors or patterns. However, the four sheets may be identical or the sheets may be formed with four different colors or patterns. These and other variations will be apparent to a person skilled in this art after having read the subject application.

What is claimed is:

1. A hair accessory comprising a pouch formed from a fabric that comprises an elastic material, the pouch having an opening edge and defining a substantially continuous enclosure at all locations spaced from the opening edge, an elastic cord defining a first loop secured in a hem of said fabric around said opening edge of said pouch and a braided elastic band defining a continuous second loop located outside of an adjacent to the hem, wherein, a portion of the second loop passing through the first loop substantially adjacent the hem so that the second loop is interengaged with the first loop defined by the elastic cord secured in the hem of the pouch and so that remaining portions of the second loop project from the pouch, whereby the second loop enables hair to be retained in a ponytail and whereby the first loop and the pouch then enable the hair to be retained as a bun.

2. The accessory of claim 1, wherein the pouch comprises more than two sheets of material, each said sheet having first and second intersecting curved edges and a third edge extending between the first and second edges, the first curved edge of each said sheet being secured to the second curved edge of an adjacent one of the sheets to form the substantially continuous enclosure of the pouch and the third edges of said sheets being unsecured to one another to define the opening edge of the pouch, the elastic portion defining the first loop being in proximity to the unsecured edges and being at least partly enveloped by the hem formed at said unsecured edges.

3. The accessory of claim 2, wherein all of the sheets of material are essentially identical to one another.

4. The accessory of claim 2, wherein at least on of the sheets of material is of a different color than the other sheets of material.

5. The accessory of claim 1, further comprising non-fabric adornments secured to the pouch.

6. The accessory of claim 1, wherein the pouch is formed from a plurality of sheets of material secured to one another, at least one of said sheets being of a color different from at least one other of the sheets.

7. The hair accessory of claim 1, wherein the hem is configured to expose a portion of the first loop that is sufficiently large to permit a portion of the second loop to be passed through and interengaged with the first loop.

8. The hair accessory of claim 1, wherein the first and second loops are formed from the different types of materials.

9. The hair accessory of claim 1, wherein the first and second loops are interengaged within the pouch.

10. The hair accessory of claim 1, wherein the elastic material of the pouch is dimensioned to the stretched over the bun for holding the bun in a tight neatly contained shape.

11. The hair accessory of claim 10, further comprising non-fabric adornments secured to the pouch.

12. A method for securing a section of hair as a bun, said method comprising:

providing a hair accessory comprising a pouch having an opening edge, an elastic portion defining a first loop secured in a hem of the pouch adjacent the opening edge of the pouch and an elastic band defining a second loop, located outside of and adjacent to the hem, wherein, a portion of the second loop being interengaged with the first loop in proximity to the opening edge so that remaining portions of the second loop project from the pouch;

holding the hair in a ponytail;

securing the elastic band defining the second loop around the hair for retaining the hair in the ponytail;

folding the ponytail substantially into a form of a bun; and elastically engaging the pouch over the previously formed bun so that the elastic portion defining the first loop in the hem adjacent the opening edge of the pouch substantially overlies the elastic band that defines the second loop for covering the previously formed bun and holding the previously formed bun in place.

13. The method of claim 12, wherein the pouch is formed from an elastic material, and wherein the step of elastically engaging the pouch over the bun comprises expanding the pouch to envelop the bun and then permitting the elastic portion of the first loop to snap into engagement with the bun.

* * * * *